US005829277A

United States Patent [19]

Wunderlich

[11] Patent Number: 5,829,277

[45] Date of Patent: Nov. 3, 1998

[54] TOP LOADING CLOTHES WASHER

[75] Inventor: Daniel F. Wunderlich, Newton, Iowa

[73] Assignee: Maytag Corporation, Newton, Iowa

[21] Appl. No.: 767,166

[22] Filed: Dec. 16, 1996

[51] Int. Cl.[6] ..... D06F 23/04

[52] U.S. Cl. ..... 68/23.6; 68/58; 68/131; 68/171

[58] Field of Search ..... 68/23.6, 23.7, 68/24, 28, 58, 131, 132, 133, 171, 174

[56] References Cited

U.S. PATENT DOCUMENTS

| | | | |
|---|---|---|---|
| 482,684 | 9/1892 | Herder | 68/58 |
| 1,553,690 | 9/1925 | Hogan | 68/131 |
| 1,613,391 | 1/1927 | Greene | 68/131 |
| 1,814,031 | 7/1931 | Gleaves | 68/131 |
| 1,839,857 | 1/1932 | Apple . | |
| 2,034,244 | 3/1936 | Mikulasek | 68/131 |
| 2,145,453 | 1/1939 | Miller . | |
| 2,344,253 | 3/1944 | Kirby . | |
| 2,381,545 | 8/1945 | Kirby . | |
| 2,408,509 | 10/1946 | Clark | 68/131 |
| 2,499,025 | 2/1950 | Horvath . | |
| 2,520,685 | 8/1950 | Horvath . | |
| 2,542,528 | 2/1951 | Horvath . | |
| 2,645,107 | 8/1953 | Smith . | |
| 2,645,917 | 7/1953 | Kirby . | |
| 2,906,111 | 9/1959 | Long et al. | 68/23.6 |
| 3,155,462 | 11/1964 | Erickson et al. . | |
| 3,318,119 | 5/1967 | Barks . | |
| 3,491,387 | 1/1970 | Candor et al. . | |
| 3,635,055 | 1/1972 | Smith | 68/131 |
| 4,114,406 | 9/1978 | Horowitz et al. . | |
| 4,483,161 | 11/1984 | Oida . | |
| 4,631,934 | 12/1986 | Imanishi et al. | 68/174 |

FOREIGN PATENT DOCUMENTS

| | | | |
|---|---|---|---|
| 186592 | 10/1984 | Japan | 68/23.6 |

*Primary Examiner*—Amy B. Vanatta
*Attorney, Agent, or Firm*—Zarley, McKee, Thomte, Voorhees & Sease

[57] ABSTRACT

An improved washing machine is provided with a rotatable wash basket having rotatable agitators mounted therein. The agitators have the shape of a spherical segment so as to nest adjacent the interior surface of the wash basket. The agitators include a spur gear which meshes with a ring gear extending around the wash basket so as to impart rotation to the agitators as the wash basket rotates within the ring gear. The agitators include ribs or baffles to impart tumbling or mixing action to the laundry in the wash or rinse water in the wash basket.

17 Claims, 2 Drawing Sheets

TOP LOADING CLOTHES WASHER

BACKGROUND OF THE INVENTION

Conventional clothes washing machines are built in two basic types: a vertical axis, top loading machine and a horizontal axis front loading machine. The top loading machines are common in the United States, while the front loading machines are common in Europe. While front loading machines are generally more economical with respect to water consumption and electrical usage, the top loading machines are typically preferred by United States customers. Both types of washing machines include a rotatable basket which holds the clothes or articles being washed. In the front loading machine, the clothes are tumbled in the wash water while the basket rotates. In a top loading machine, an oscillating or rotating agitator mixes the clothes and articles in the wash water while the basket remains substantially stationary. At the completion of the wash cycle in either machine, the basket is rotated at a high RPM to extract the wash water from the basket and the clothes therein.

An objective of the present invention is the provision of an improved top loading, vertical axis washing machine.

Another objective of the present invention is the provision of a vertical axis washing machine having low water usage, yet excellent mechanical washing action.

Another objective of the present invention is the provision of a top loading washing machine having a simple and durable construction.

A further objective of the present invention is the provision of an improved top loading, vertical axis washing machine which is economical to manufacture and to operate.

These and other objectives will become apparent from the following description of the invention.

SUMMARY OF THE INVENTION

An improved top loading, vertical axis washing machine is provided with a rotatable spherical wash basket. The wash basket has an opening at the top for loading and unloading clothes and other articles to be washed therein. A pair of agitators are mounted on opposite sides within the spherical basket. Each agitator has the shape of a spherical segment so as to nest within the spherical basket. Each agitator includes an axle extending through the basket, with a spur gear on the end of the axle. A ring gear extends around the spherical basket, and the spur gears are in mesh with the ring gear. The ring gear is formed by a plurality of teeth extending around an upper perimeter edge of a semi-spherical body mounted beneath the spherical basket.

During the wash and rinse cycles, the spherical basket is rotated relative to the ring gear, such that the spur gears roll along and mesh with the ring gear, thereby rotating the agitators relative to the basket. The agitators include ribs which force the laundry to move within the water in the basket. Whenever a wash or rinse cycle is completed, the basket is rotated in the opposite direction, with a key mechanism being actuated so as to fix the ring gear for rotation with the basket in the opposite direction. With the basket and ring gear rotating together, the spur gears do not roll along the ring gear, thereby maintaining the agitators against rotation relative to the basket. A plurality of drainage holes are provided in the basket for draining wash and rinse water therefrom.

DETAILED DESCRIPTION OF THE DRAWINGS

Figure 1:
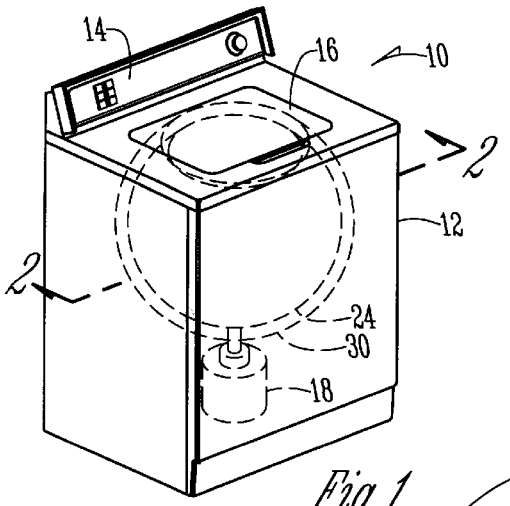
FIG. 1 is a perspective view of a top loading, vertical axis washing machine showing the spherical basket of the present invention mounted within the cabinet of the washing machine.
Figure 5:
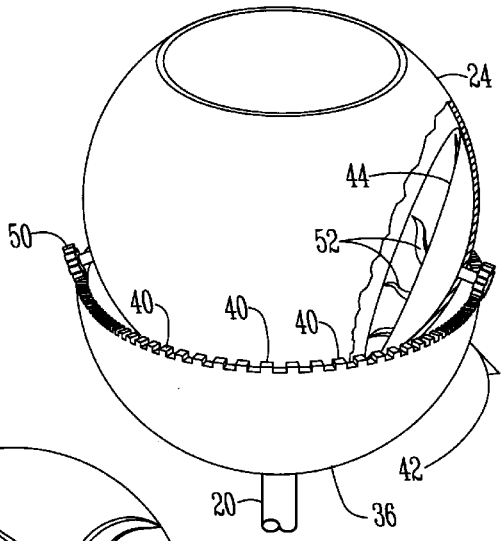
FIG. 5 is a perspective view of the ring gear and spherical basket, with a portion of the basket wall being broken away to show an agitator.
Figure 4:
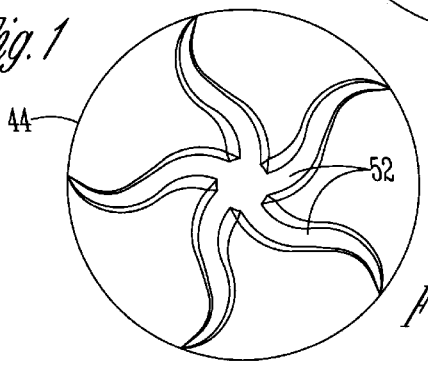
FIG. 4 is an elevation view of the inner surface of an agitator of the present invention.
Figure 3:
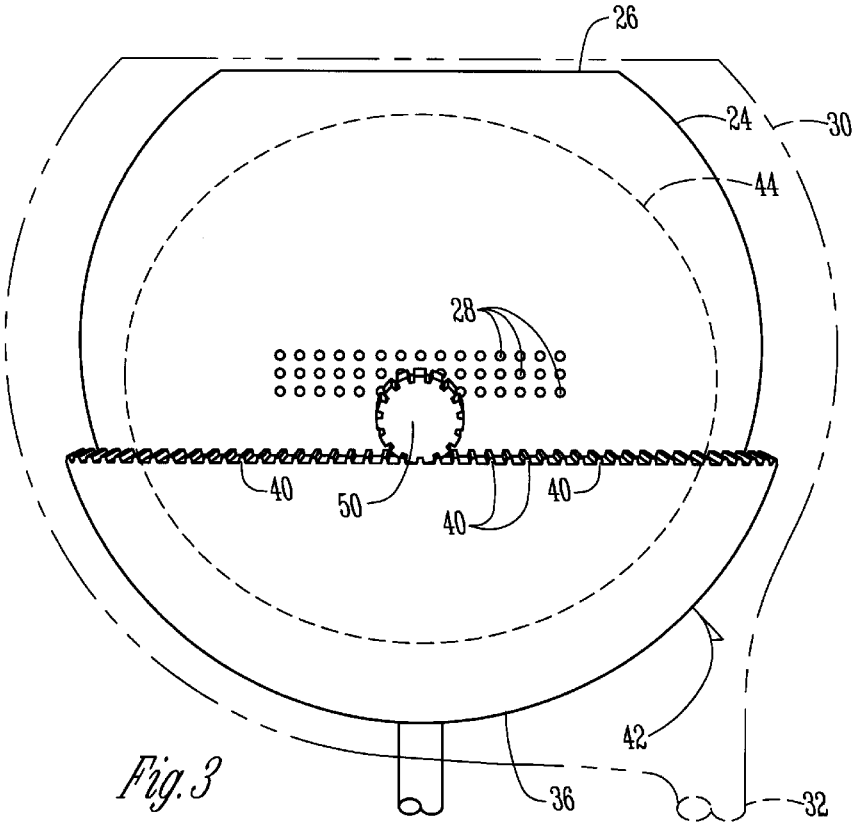
FIG. 3 is a side elevation view taken along lines 3—3 of FIGS. 2 showing the ring gear, spherical basket, and an agitator of the present invention, with the outer tub shown in broken lines for clarity.

With reference to the drawings, a top loading, vertical axis washing machine 10 includes a cabinet 12 and a control panel 14. The cabinet 12 has an opening 15 in the top thereof, with a door 16 movable between open and closed positions relative to the opening 15. A reversible drive motor 18 is mounted within the cabinet 12 and includes a rotatable output shaft 20 which extends vertically through a bearing 22.

The above construction of the washing machine 10 is conventional and does not form a part of the present invention.

The present invention is directed towards a spherical wash basket 24. The wash basket 24 is mounted to the output shaft 20 for rotation therewith. The wash basket 24 has an open upper end 26 to provide access to the interior of the basket 24 for loading and unloading clothes and other articles to be washed therein. The wash basket 24 includes a plurality of drainage holes 28 to drain water from the basket 24. The holes 28 may extend circumferentially around the basket 24, or may be arranged in grouped sections of the basket 24. The drain holes 28 are provided at least in the largest diameter of the spherical basket 24, and may be provided in other areas of the basket 24.

The wash basket 24 is contained within a tub 30. The tub 30 is adapted to hold water for washing laundry within the basket 24. The tub 30 is provided with a drain opening 32. The output shaft 20 of the drive motor 18 extends through the tub 30 and a bearing 34 mounted in the bottom of the tub 30.

A semi-spherical body 36 is mounted upon the output shaft 20 between the wash basket 24 and the tub 30. A keyed bearing or clutch mechanism 38 is provided in the body 36, such that the body 36 is fixed relative to the shaft 20 when the shaft 20 rotates in a first direction, and such that the body 36 rotates with the shaft 20 when the shaft 20 is rotated in the opposite direction. The upper perimeter edge of the semi-spherical body 36 includes a plurality of gear teeth 40 which define a ring gear 42.

One or more agitators 44 are provided within the wash basket 24 so as to move the clothes and other articles within the wash and rinse water. Preferably, at least two agitators 44 are provided in the basket 24, as shown in the drawings. The agitators 44 are equally spaced from one another. The agitators 44 have the shape of a spherical segment so as to nest closely adjacent the interior surface of the wash basket 24. Each agitator 44 includes an axle 46 extending through a bearing 48 in the basket 24. A spur gear 50 is provided on the outer end of the axle 46, and is in meshing engagement with the ring gear 42. Thus when the wash basket 24 is rotated in a first direction, the spur gear 50 rolls along the ring gear 42 to cause the agitator 44 to rotate about the axle 46. The agitators 44 include a plurality of ribs or baffles 52 which facilitate the mixing action of the laundry within the wash or rinse water as the agitators 44 are rotated.

Figure 2:
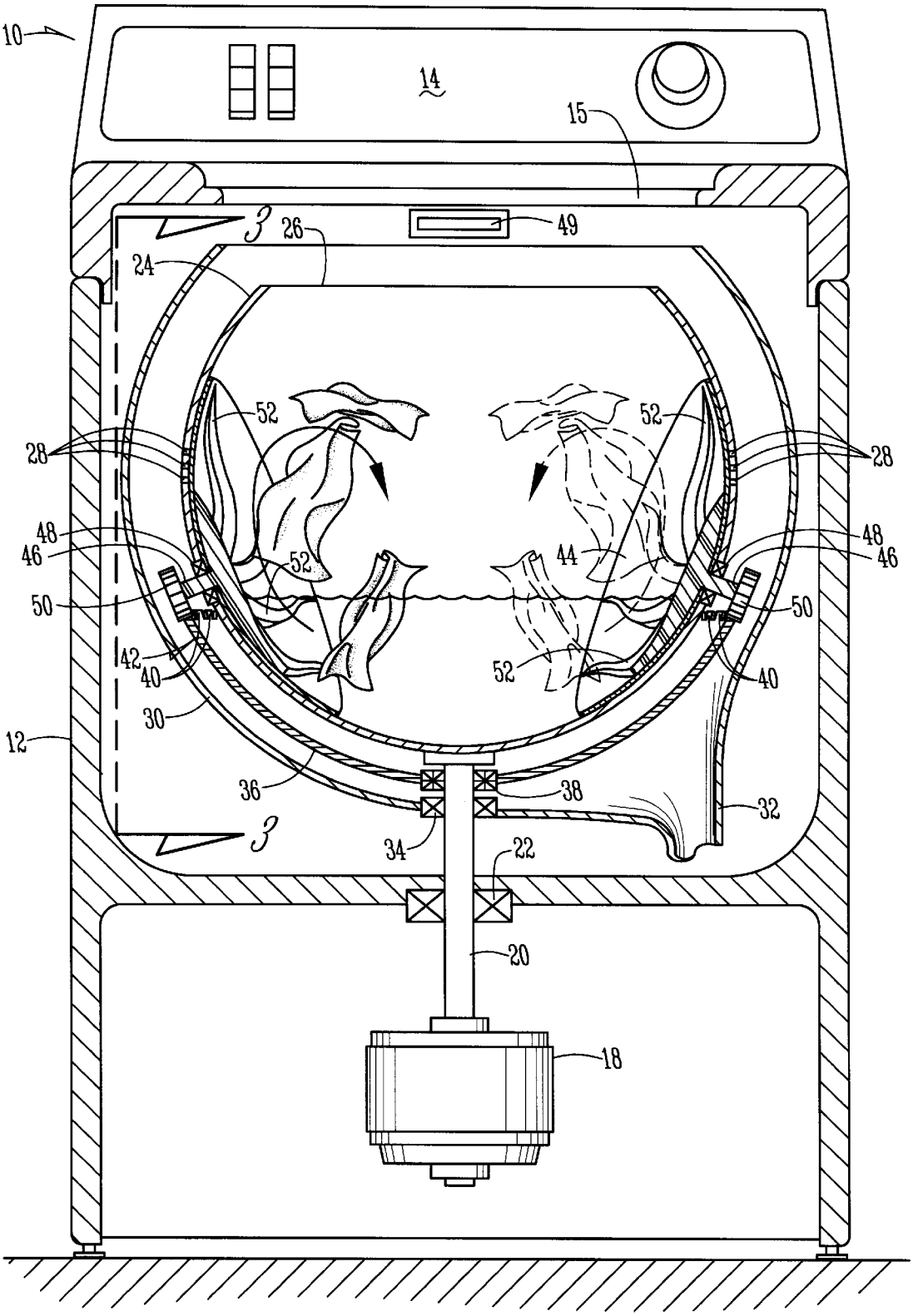
FIG. 2 is an enlarged sectional view taken along lines 2—2 of FIG. 1.

In the operation of the washing machine 10, the tub 30 and washing basket 24 are filled with water from a water supply line (not shown) through an inlet flume 49 adjacent the top of the tub 30. After the clothes or other articles are loaded into the wash basket 24 and the desired quantity of wash or rinse water is provided, the motor 18 is actuated to rotate the shaft 20 in a first direction. Upon rotation of the shaft 20 in the first direction, the semi-spherical body 36 and ring gear 42 remain stationary while the wash basket 24 rotates in the first direction. Such rotation of the wash basket 24 in the first direction causes the spur gears 50 to roll along the ring gear 42 and thereby rotate the agitators 44 about their respective axles 46. The rotational speed of the agitators 44 depends upon the rotational speed of the wash basket 24 and the gear ratio of the spur gears 50 with respect to the ring gear 42. Thus, the ribs 52 of the agitators 44 impart a mixing action, as designated by the arrows in FIG. 2, to the clothes and articles in the wash or rinse water in the wash basket 24. The wash and rinse cycles of the washing machine 10 are substantially identical with respect to the rotation of the wash basket 24 and the agitators 44.

Upon completion of a wash or rinse cycle, the motor 18 is reversed such that the output shaft 20 rotates in the opposite direction at a relatively high speed. This opposite rotation of the shaft 20 actuates the keyed bearing or clutch mechanism 38 such that the semi-spherical body 36 and wash basket 24 rotate in unison in the opposite direction. Since the wash basket 24 and ring gear 42 are moving together, the spur gears 50 cannot roll along the ring gear 42, so that the agitators 44 do not rotate about their axles 46. The centrifugal force of the high speed rotating basket 24 forces the water from the basket 24 and the clothes therein via the drain holes 28. The spherical shape of the wash basket 24 forces the water to the level of the wash basket 24 that has the greatest diameter.

With the improved top loading, vertical axis washing machine of the present invention, the clothes and articles being washed are tumbled by the action of the rotating agitators 44 as the wash basket 24 rotates in a reduced quantity of water as compared to other known vertical axis washers. This tumbling action of the clothes and articles is similar to that achieved with a rotating horizontal axis washing machine and enhances the cleaning of the laundry with less water. The vertical axis orientation of the wash basket 24 allows for large capacity loads, while providing a large opening with top accessibility to the interior of the basket, as in previous vertical axis machines. Thus, the washing machine of the present invention includes the benefits of both conventional vertical axis and horizontal axis machines.

Whereas the invention has been shown and described in connection with the preferred embodiments thereof, it will be understood that many modifications, substitutions, and additions may be made which are within the intended broad scope of the following claims. From the foregoing, it can be seen that the present invention accomplishes at least all of the stated objectives.

What is claimed is:

1. An improved washing machine including a cabinet with a top opening and a door positioned over the opening, and a drive motor mounted in the cabinet with a rotatable output shaft, the improvement comprising:

a wash basket mounted on the output shaft for rotation therewith and having interior and exterior surfaces, the basket having an upper opening through which clothes are loaded and unloaded, a rotatable agitator mounted in the basket, the agitator having a plurality of ribs for agitating articles being washed in the basket and an axis of rotation offset with respect to the output shaft.

2. The washing machine of claim 1 wherein the basket is substantially spherical.

3. The washing machine of claim 2 wherein the agitator has the shape of a spherical segment.

4. The washing machine of claim 1 wherein the agitator is nested adjacent the interior surface of the basket.

5. The washing machine of claim 1 further comprising a ring gear extending around the basket, the agitator having an axle extending through the basket with a spur gear in meshing engagement with the ring gear, whereby the spur gear rotates along the ring gear upon rotation of the basket in one direction thereby imparting rotation to the agitator.

6. The washing machine of claim 5 further comprising a key for operatively locking the ring gear to the basket when the basket is rotated in an opposite direction such that the agitator is fixed relative to the basket.

7. The washing machine of claim 5 wherein the ring gear includes a semi-spherical body having an upper perimeter edge with a plurality of gear teeth extending therearound.

8. The washing machine of claim 7 wherein the semi-spherical body is mounted on the output shaft below the basket, and is adapted to be fixed relative to the basket when the basket rotates in the one direction and is adapted to rotate with the basket when the basket rotates in the opposite direction.

9. The washing machine of claim 1 wherein the basket includes a plurality of drainage holes.

10. The washing machine of claim 1 further comprising a second rotatable agitator mounted in the basket opposite the first agitator.

11. An improved washing machine comprising:

a rotatable wash basket;

a first drive member in cooperable juxtaposition to the wash basket;

a rotatable agitator mounted in the basket and having an axle extending through the basket;

a second drive member on the end of the axle, the second drive member engageable with the first drive member, whereby the agitator is rotated relative to the wash basket upon rotation of the wash basket relative to the first drive member.

12. The washing machine of claim 11 wherein the first and second drive members include a ring gear extending around the wash basket and a spur gear in mesh with the ring gear.

13. The washing machine of claim 11 wherein the basket is rotatable in opposite first and second directions, the washing machine further comprising a key operative to fix the ring gear against rotation when the wash basket rotates in the first direction such that the agitator rotates relative to the wash basket, and operative to rotate the ring gear with the basket when the wash basket is rotated in the second direction such that the agitator is fixed relative to the wash basket.

14. The washing machine of claim 11 wherein the basket has a substantially spherical shape and the agitator has a spherical segment shape so as to nest within the wash basket.

15. The washing machine of claim 14 wherein the ring gear is formed on a perimeter edge of a semi-spherical body extending partially around the wash basket.

16. The washing machine of claim 11 wherein the basket and agitator have axes of rotation offset with respect to one another.

17. The washing machine of claim 11 wherein the basket includes drainage holes to drain water from the wash basket.

* * * * *